US006026893A

United States Patent [19]

Jung et al.

[11] Patent Number: 6,026,893

[45] Date of Patent: Feb. 22, 2000

[54] FIN-TYPE HEAT EXCHANGER HAVING SLITS FORMED THEREIN

[75] Inventors: Gyoo-Ha Jung; Young-Dawn Bae; Sung-Han Jung, all of Kyungki-Do, Rep. of Korea

[73] Assignee: Samsung Electronics Co., Ltd., Suwon, Rep. of Korea

[21] Appl. No.: 09/081,601

[22] Filed: May 20, 1998

[30] Foreign Application Priority Data

Aug. 30, 1997 [KR] Rep. of Korea ..... 97-45020

[51] Int. Cl.[7] ..... F28D 1/047; F28F 13/02

[52] U.S. Cl. ..... 165/151; 165/146; 165/181

[58] Field of Search ..... 165/151, 181, 165/146

[56] References Cited

U.S. PATENT DOCUMENTS

| | | | |
|---|---|---|---|
| 4,907,646 | 3/1990 | Aoyagi et al. | 165/151 |
| 5,667,006 | 9/1997 | Kang et al. | 165/151 |
| 5,692,561 | 12/1997 | Kang et al. | 165/151 |
| 5,755,281 | 5/1998 | Kang et al. | 165/151 |

FOREIGN PATENT DOCUMENTS

| | | | |
|---|---|---|---|
| 1521499 | 4/1968 | France | 165/151 |
| 110995 | 1/1954 | Japan . | |
| 9196 | 1/1987 | Japan | 165/151 |
| 3181 | 1/1988 | Japan | 165/146 |

*Primary Examiner*—Leonard Leo
*Attorney, Agent, or Firm*—Burns, Doane, Swecker & Mathis, L.L.P.

[57] ABSTRACT

A fin type heat exchanger includes a plurality of plate shaped fins disposed in spaced parallel relationship to define air channels therebetween for conducting an air flow from an air inlet side to an air exhaust side of each fin. A bent pipe extends through pipe holes formed in the fins for conducting a heat exchange fluid. Groups of slits are formed in each fin, whereby there is a first row of slit groups adjacent the air intake side, and a second row of slit groups adjacent the air exhaust side. There are more slits in the first row than in the second row. The slits in the first row have a width greater than the width of the slits disposed in the second row.

3 Claims, 4 Drawing Sheets

FIN-TYPE HEAT EXCHANGER HAVING SLITS FORMED THEREIN

BACKGROUND OF THE INVENTION (a) Field of the Invention

The present invention relates to a fin-type heat exchanger, and more particularly, to a fin-type heat exchanger in which an arrangement of slits formed on fins is improved to enhance heat exchange efficiency and reduce noise.

(b) Description of the Prior Art

Fin-type heat exchangers are generally structured to include a pipe bent a plurality of times, and fins disposed parallel to one another at predetermined intervals with the pipe passing therethrough. Such a heat exchanger is used in air conditioners, etc. to carry out heat exchange between external air passing over the fins and an external surface of the pipe, and operating fluid flowing through the pipe.

The fins receive heat from the pipe and exchange heat with the surrounding air. That is, heat from the pipe is transmitted to the fins such that an area of heat transmission is greatly increased. To further improve this function, a plurality of slits are formed by partially cutting out portions of the fin and bending the cut-outs so that they protrude from a surface of each fin. The slits are formed in groups around locations where the pipe passes through the fins so that air passes over the surface of the same after being directed onto the pipe.

Referring to FIGS. 4 and 5, shown respectively are a side view of a prior art fin 2 and a view taken along line V—V of FIG. 4. As shown in the drawings, a plurality of pipe holes 3*a* and 3*b* are formed in the fin 2, a pipe (not shown) passing through the pipe holes 3*a* and 3*b*. Formed in a longitudinal direction on a surface of the fin 2 and between the pipe holes 3*a* and 3*b* are a plurality of slits 4 and 5. That is, the slits 4 and 5 are formed in a direction perpendicular to a direction in which air passes between the fin 2 (shown by the arrows to the left of the fin 2 in the drawing).

In air conditioners, air is typically directed to the heat exchanger by a fan (not shown) to facilitate heat exchange. Here, the pipe holes 3*a* are positioned in a row on an upstream side of the fin 2 to form a first row 2*a*, while the pipe holes 3*b* are positioned in a row on a downstream side of the fin 2 to form a second row 2*b*. To improve heat-exchange efficiency (i.e. to expose as much of the outside surfaces of the pipe and fin 2 to the fan-blown air), the pipe holes 3*a* of the first row 2*a* are non-aligned with respect to the pipe holes 3*b* of the second row 2*b* in the direction of air flow.

Groups of slits 4 and 5, formed between the pipe holes 3*a* and 3*b*, respectively are formed by partially cutting-out portions of the fin and then bending the cut-outs such that they project from a fin surface. In the prior art fin of FIGS. 4–5, the cut-outs project from the same surface of the fin 2 and are formed in a plurality of rows. Further, the slits 4 formed between the pipe holes 3*a* of the first row 2*a* are identical in shape and pattern to the slits 5 formed between the pipe holes 3*b* of the second row 2*b*. The slits 4 and 5 act to improve heat transmission efficiency by minimizing the depth that can be achieved by the temperature boundary layer of the air flow.

However, in the above prior art fin-type heat exchanger, because the depth of the temperature boundary layer increases in a downstream direction of air flow, the heat transmission efficiency is decreased in that direction. Also, a formation of the slits 4 and 5 over substantially the entire surface of the fin 2 creates resistance to air flowing over the same such that heat transmission efficiency is reduced.

To remedy this problem, Japanese Laid-open Patent No. 4-93595 proposes a heat exchanger having a fin 12 as shown in FIGS. 6 and 7, respectively illustrating a side view of the fin 12 and a view taken along line VII—VII of FIG. 6.

As shown in the drawings, pipe holes 13*a* positioned in an upstream side of the fin 12 are non-aligned with respect to pipe holes 13*b* positioned in a downstream a side of the fin 12, as in the above-described prior art heat exchanger to improve heat-exchange efficiency.

Further, a groups of slits 14 and 15 are provided, respectively, between the pipe holes 13*a* and 13*b* on a surface of the fin 12, the slits 14 and 15 being formed in a plurality of rows 12*a*, 12*b*. However, the number of slits 14 formed in each group of the first row 12*a* is greater than the number of slits 15 formed in each group of the second row 12*b*. In addition, the slits 14 have their cut-outs projecting from both surfaces of the fin (see FIG. 7), whereas the slits 15 have their cut-outs projecting from only one of the fin surfaces.

However, as the exchange of heat is realized more actively in the first (upstream) row 12*a* than in the second (downstream) row 12*b* in all heat exchangers, the fact that there are more upstream slits 14 than downstream slits 15 means that heat transmission is realized unevenly between these upstream and downstream sides of the fin 12, resulting in a reduction in the efficiency of heat transmission.

Further, as it is common for much condensation to form on the upstream side of the fin 12, the fact that the slits 14 are formed over substantially the entire surface of the upstream side of the fin 12, means that the water generated by condensation can not easily be exhausted from the surface of the fin 12. Over time, this results in a residue forming on the surface of the fin 12 such that heat exchange efficiency is reduced.

Also, as the slits 15' formed closest to a downstream edge of the fin 12 are spaced from the pipe holes 13*b* of the second row 12*b* at a considerable distance, much air flows between the slits 15' and the pipe holes 13*b*.

Accordingly, air passes unevenly over the surface of the fin 12 in this area, and noise is created by the large amount of air passing between the slits and pipe holes.

Finally, as the upstream slits 14 have their cut-outs projecting from both surfaces of the fin 12, the manufacturing process is complicated and overall manufacturing costs are increased.

SUMMARY OF THE INVENTION

The present invention has been made in an effort to solve the above problems.

It is an object of the present invention to provide a fin-type heat exchanger in which an arrangement of slits formed on fins is improved to enhance heat exchange efficiency, and enable heat transmission to be uniformly realized at upstream and downstream sides of the fin, and such that the generation of noise is reduced.

To achieve the above object, the present invention provides a fin-type heat exchanger. The heat exchanger includes a plurality of plate-shaped fins disposed in spaced parallel relationship to define air channels therebetween for conducting an air flow from an air inlet side to an air exhaust side of each fin. First and second rows of pipe holes are formed in each fin adjacent the air intake side and air exhaust side, respectively. A bent pipe extends through the pipe holes for conducting a heat exchange fluid. Groups of slits are formed in each fin between adjacent pipe holes in each of the first and second rows of pipe holes. There are thus formed a first row of slit groups adjacent the air intake side, and a second row of slits adjacent the air exhaust side. There are more slits in the first row of slits than in the second row of slit groups. The slits have a width dimension in the direction of air flow, and a length dimension perpendicular to the direction of air flow. The width of the slit groups disposed in the first row of slit groups is greater than the width of the slits disposed in the second row of slit groups.

Preferably, each group of slits in the second row of slit groups includes slits spaced apart in the direction of air flow, whereby one of the spaced apart slits is disposed closer to the exhaust side and has a longer length than the other of the spaced apart slits.

The pipe holes of the first row of pipe holes are preferably non aligned with respect to the pipe holes of the second row of pipe holes in the direction of air flow.

Preferably, each slit is formed by partially cutting out a portion of the fin and projecting the cut-outs from the fin surface. All of the slits have their cutouts projecting from the same surface of the fin.

BRIEF DESCRIPTION OF THE DRAWINGS

Further objects and other advantages of the present invention will become apparent from the following description in conjunction with the attached drawings, in which.

DETAILED DESCRIPTION OF A PREFERRED EMBODIMENT

A preferred embodiment of the present invention will now be described in detail with reference to FIGS. 1–3.

Figure 1:
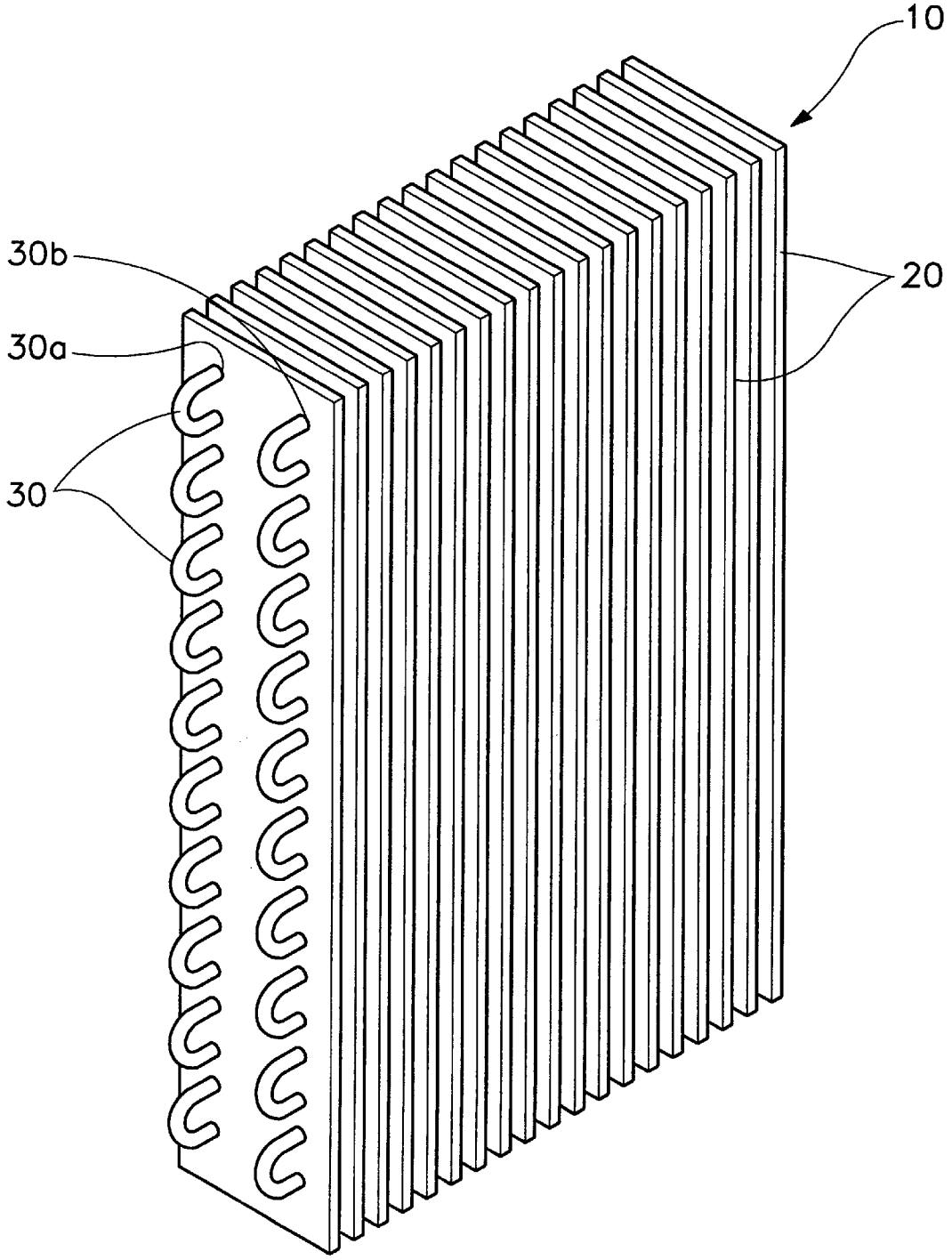
FIG. 1 is a perspective view of a fin-type heat exchanger according to a preferred embodiment of the present invention.

Referring first to FIG. 1, shown is a perspective view of an inventive fin-type heat exchanger 10. The heat exchanger 10 comprises a plurality of plate-shaped fins 20 disposed parallel to one another at predetermined intervals, the fins 20 having at least two rows of pipe holes 30*a* and 30*b* formed along a length of the fins 20 at predetermined intervals, and a pipe 30 inserted into the pipe holes 30*a* and 30*b* by being bent outside of the heat exchanger 10. Refrigerant or other operational fluid passes through the pipe 30 and realizes heat exchange with air passing over external surfaces of the pipe 30 and fins 20 by using the same as a heat exchange medium.

Figure 2:
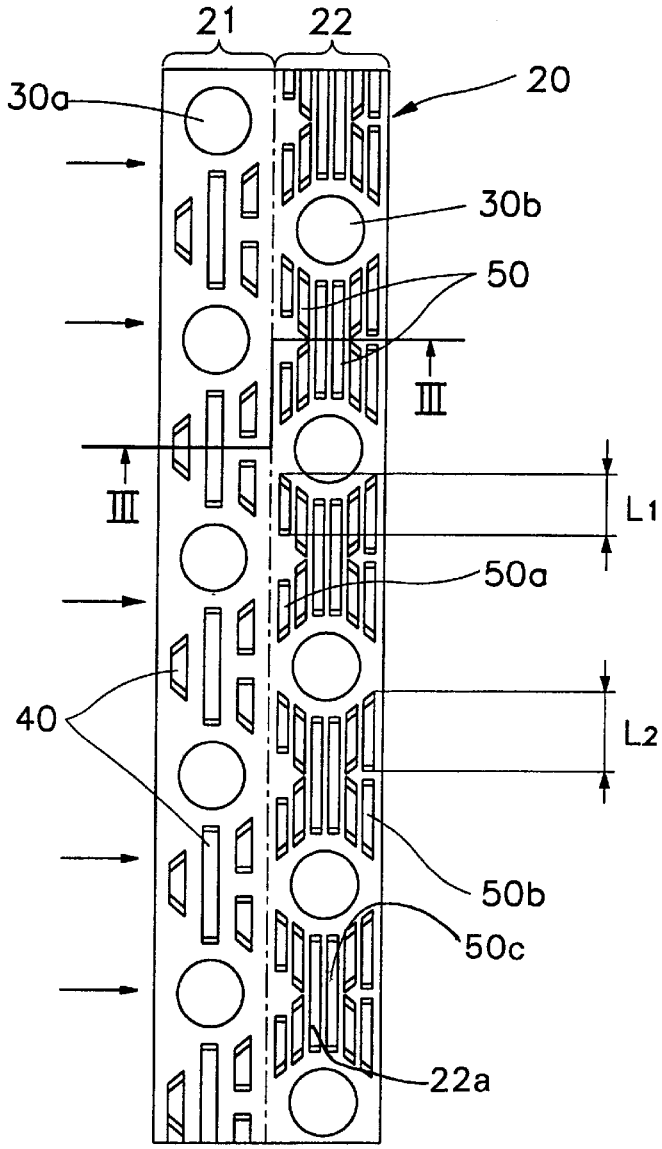
FIG. 2 is a side view of a fin shown in FIG. 1.

As shown in FIG. 2, illustrating a side view of one of the fins 20 shown in FIG. 1, the fin 20 is divided into two sides, namely, an intake (upstream) side 21 in which the pipe holes 30*a* are provided in a row and onto which air is initially directed by a fan, and an exhaust (downstream) side 22 in which the pipe holes 30*b* are provided in a row and onto which air passes before exiting the fin 20. To improve heat-exchange efficiency (i.e. to expose as much of the outside surfaces of the pipe 30 and fins 20 to the fan-blown air), the pipe holes 30*a* on the intake side 21 are non-aligned with respect to the pipe holes 30*b* on the exhaust side 22, in the direction of air flow.

Further, formed in a longitudinal direction in the fin 20 and between the pipe holes 30*a* and 30*b* are a plurality of groups of slits 40 and 50, respectively formed in the intake and exhaust sides 21 and 22. That is, the slits 40 and 50 are formed in a direction perpendicular to a direction in which air passes over the fin 2 (shown by the arrows to the left of the fin 20 in the drawing). Each slit is formed by partially cutting-out a portion of the fin and bending the cut-out away from the fin surface. All of the fins have their cut-outs projecting from the same fin surface (see FIG. 3). The slits 40 and 50 increase an area of heat transmission of the heat exchanger 10, and, at the same time, act to direct air onto the pipe 30 before the air exits the heat exchanger 10.

As heat exchange is typically realized more actively on the upstream side of the fin than on the downstream side, if the number of slits on both these sides are equal, or greater on the upstream side, most of the heat exchange occurs on the upstream side such that an uneven heat exchange and a drop in the strength of air passing through the heat exchanger result.

Accordingly, in the present invention, the number of slits 50 formed on the exhaust or downstream side 22 of the fin 20 is greater than the number of slits 40 formed on the intake or upstream side 21 of the fin 20 such that heat exchange is realized evenly on both the intake and exhaust sides 21 and 22, and pressure loss of the air passing through the heat exchanger 10 is reduced. Here, it is preferable that the number of slits 40 on the intake side 21 is roughly 60 to 80% of the number of slits 50 on the exhaust side 22.

Figure 3:
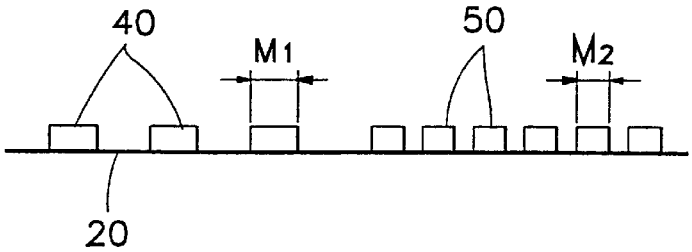
FIG. 3 is an enlarged sectional view taken along line III—III of FIG. 2.
Figure 4:
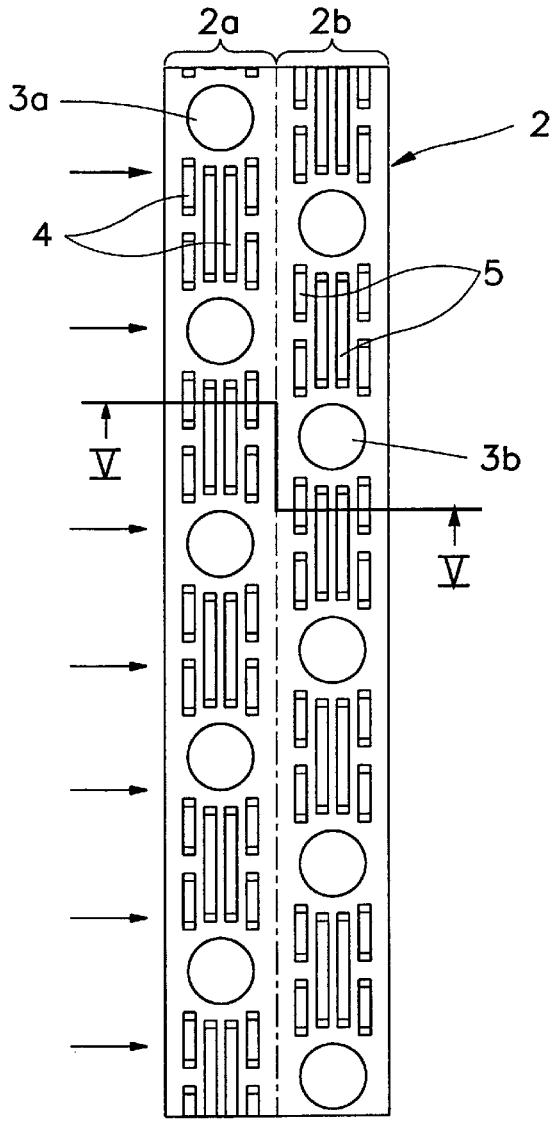
FIG. 4 (PRIOR ART)
FIG. 4 is a side view of a fin of a first prior art heat exchanger.
Figure 5:
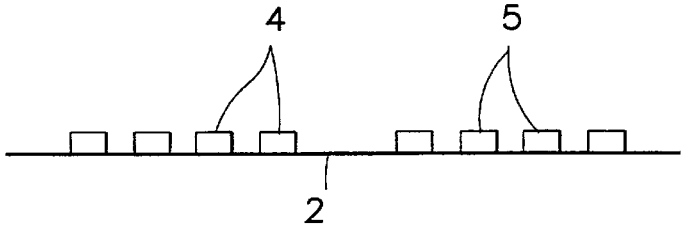
FIG. 5 (PRIOR ART)
FIG. 5 is an enlarged sectional view taken along line V—V of FIG. 4.
Figure 6:
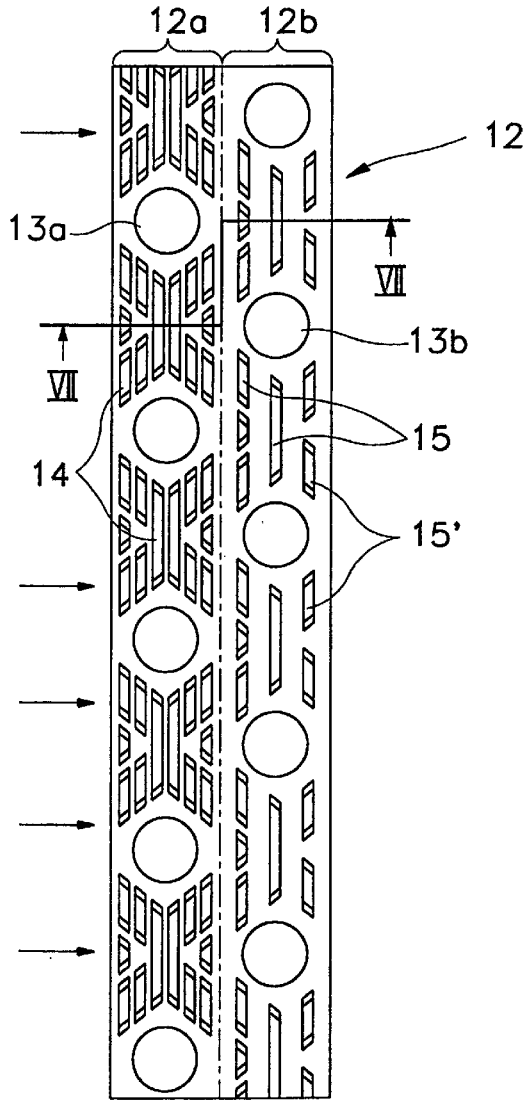
FIG. 6 (PRIOR ART)
FIG. 6 is a side view of a fin of another prior art heat exchanger.
Figure 7:
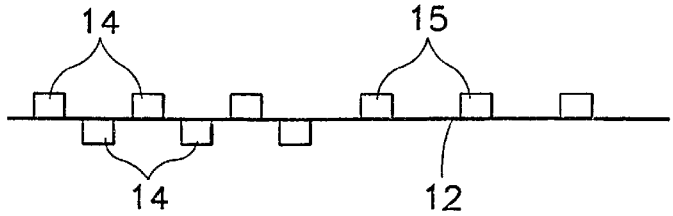
FIG. 7 (PRIOR ART)
FIG. 7 is an enlarged sectional view taken along line VII—VII of FIG. 6.

As shown in FIG. 3, illustrating an enlarged sectional view taken along line III—III of FIG. 2, a width Ml (i.e., a dimension in the direction of air flow) of the slits 40 formed on the intake side 21 of the fin 20 is greater than a width M2 of the slits 50 formed on the exhaust side 22 of the fin 20 to prevent an insufficient amount of heat exchange being realized on the intake side 21 due to the smaller number of slits 40 provided thereon. Further, a length L2 (i.e., a dimension perpendicular to the direction of air flow) of a last row of slits 50*b* formed on the exhaust side 22 and located adjacent to a downstream edge 22*a* of the exhaust side, is larger than a length L1 of a first row of slits 50*a* formed on the exhaust side 22 but located farther from the downstream edge, such that air passing over the fin 20 is distributed evenly, and the generation of noise is reduced.

Each second slit group includes central slits 50*c* located between the slits 50*a* and 50*b* and which are longer than the slit 50*b*.

The operation of the heat exchanger 10 structured as described above will be explained hereinafter.

As operational fluid such as refrigerant passes through the pipe 30, a fan blows air onto the heat exchanger 10 such that air passes over the fins 20 and pipe 30, thereby realizing a heat exchange. Here, due to the presence of the slits 40 and 50, an area of heat transmission of the same is increased such that more active heat exchange occurs. Further, as the number of slits 40 formed on the intake side 21 of the fin 20 is smaller than the number of slits 50 formed on the exhaust side 22 of the fin 20, heat exchange is realized more uniformly.

The width W1 of the slits formed on the upstream side is greater than the width W2 of the slits formed on the downstream side, to compensate for the smaller number of upstream slits.

In addition, because the length L1 of the first row of slits 50*a* formed on the exhaust side 22 is smaller than that of the last row of slits 50*b* formed on the exhaust side 22, air is distributed more evenly and a reduction in the generation of noise is realized.

Since all of the fins have their cut-outs projecting from the same surface of the fin, the manufacture of the fin is simplified.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

What is claimed is:

1. A fin-type heat exchanger, comprising:

a plurality of plate-shaped fins disposed in spaced parallel relationship to define air channels there between for conducting an air flow from an air inlet side to an air exhaust side of each fin;

first and second rows of pipe holes formed in each fin adjacent the air intake and air exhaust sides, respectively;

a bent pipe extending through the pipe holes for conducting a heat exchange fluid;

groups of slits formed in each fin between adjacent pipe holes in each of the first and second rows of pipe holes, whereby there are formed a first row of slit groups adjacent the air intake side, and a second row of slit groups adjacent the air exhaust side, there being fewer slits in the first row of slit groups than in the second row of slit groups;

the slits having a width dimension in the direction of air flow, and a length dimension perpendicular to the direction of air flow, the width of the slits disposed in the first row of slit groups being greater than the width of the slits disposed in the second row of slit groups;

wherein each group of slits in the second row of slit groups includes slits spaced apart in the direction of air flow, whereby one of the spaced-apart slits is disposed closer to a downstream edge of the exhaust side than is another of the slits and has a longer length than said another of the spaced-apart slits.

2. The heat exchanger according to claim 1 wherein the pipe holes of the first row of pipe holes are non-aligned with respect to the pipe holes of the second row of pipe holes in the direction of air flow.

3. The heat exchanger according to claim 1 wherein each slit is formed by partially cutting-out a portion of the fin and projecting the cut-out from a fin surface; all of the slits having their cut-outs projecting from the same surface of the fin.

* * * * *